US010254091B2

(12) United States Patent
Kim et al.

(10) Patent No.: US 10,254,091 B2
(45) Date of Patent: Apr. 9, 2019

(54) CLUSTER BOMBLET HAVING BOMBLET BODY FOR PROTECTING FUSE

(71) Applicant: POONGSAN CORPORATION, Pyeongtaek-si Gyeonggi-do (KR)

(72) Inventors: Nam Jin Kim, Pohang-si (KR); Mun Soo Park, Gyeongju-si (KR); Dong Won Kim, Pohang-si (KR)

(73) Assignee: POONGSAN CORPORATION, Pyeongtaek-si, Gyeonggi-do (KR)

( * ) Notice: Subject to any disclaimer, the term of this patent is extended or adjusted under 35 U.S.C. 154(b) by 0 days.

(21) Appl. No.: 15/736,881

(22) PCT Filed: Jun. 4, 2016

(86) PCT No.: PCT/KR2016/005956
§ 371 (c)(1),
(2) Date: Dec. 15, 2017

(87) PCT Pub. No.: WO2016/204440
PCT Pub. Date: Dec. 22, 2016

(65) Prior Publication Data

US 2018/0364015 A1 Dec. 20, 2018

(30) Foreign Application Priority Data

Jun. 18, 2015 (KR) ..... 10-2015-0086466

(51) Int. Cl.
*F42B 3/26* (2006.01)
*F42B 12/58* (2006.01)
(Continued)

(52) U.S. Cl.
CPC ..... *F42B 3/26* (2013.01); *F42B 12/58* (2013.01); *F42B 25/00* (2013.01); *F42C 14/06* (2013.01); *F42C 19/08* (2013.01)

(58) Field of Classification Search
CPC .. F42B 3/26; F42B 12/58; F42B 25/00; F42C 14/06; F42C 19/08
(Continued)

(56) References Cited

U.S. PATENT DOCUMENTS 3,971,319 A * 7/1976 Larson ..... F42C 15/36 181/112
4,784,062 A * 11/1988 Rudolf ..... F42C 19/0842 102/254
(Continued)

FOREIGN PATENT DOCUMENTS

KR 10-1997-0001239 B1 2/1997
KR 10-1078153 B1 10/2011
(Continued)

*Primary Examiner* — Samir Abdosh
(74) *Attorney, Agent, or Firm* — Rabin & Berdo, P.C.

(57) ABSTRACT

The present invention relates to a cluster bomblet having an improved bomblet body, the cluster bomblet comprising: a cylindrical bomblet body (10) packed with high explosives; a fuse assembly (20) having a striker screw (21) for exploding the high explosives and coupled to the top side of the bomblet body; and a conical penetrator (15) provided inside the rear end portion of the bomblet body. The bomblet of the present invention has: a connecting tube (33) provided therein to seal the top side of the bomblet body (10) and to connect an initiating tube of the fuse assembly (20) and the high explosives (11); and an upper cover (30) into which a stud assembled to the fuse assembly is inserted, wherein the upper cover includes: an assembly surface portion (31) having a connecting-tube mounting hole (31*a*) and a stud insertion hole (31*b*) formed therein, the stud (22) being inserted into the stud insertion hole (31*b*); and a side wall portion (32) extending upward from the edge of the assembly surface portion (31) in order to prevent the separation of the mounted fuse assembly (20).

10 Claims, 15 Drawing Sheets

(51) Int. Cl.
*F42B 25/00* (2006.01)
*F42C 14/06* (2006.01)
*F42C 19/08* (2006.01)

(58) Field of Classification Search
USPC ..... 102/393
See application file for complete search history.

(56) References Cited

U.S. PATENT DOCUMENTS

| | | | | |
|---|---|---|---|---|
| 5,022,325 | A * | 6/1991 | Skowasch | F42C 15/184 102/226 |
| 9,476,682 | B1 * | 10/2016 | Powell | F42B 12/16 |
| 2018/0364015 | A1 * | 12/2018 | Kim | F42B 3/26 |

FOREIGN PATENT DOCUMENTS

| | | | |
|---|---|---|---|
| KR | 10-1503786 | B1 | 3/2015 |
| WO | WO 2008-092282 | A1 | 8/2008 |

* cited by examiner

CLUSTER BOMBLET HAVING BOMBLET BODY FOR PROTECTING FUSE

TECHNICAL FIELD

The present invention relates to a bomblet loaded in various types of bombs, such as a cluster bomb and a cluster. More particularly, the present invention relates to a cluster bomblet having a bomblet body for protecting a fuse, the bomblet body being improved to prevent the fuse from non-exploding by being damaged by an impact generated when the bomblet is ejected from a mother bomb or when the bomblet collides against the ground.

BACKGROUND ART

In general, a cluster munition means a wide area suppression weapon in which a large bombshell (i.e. a mother bomb) is fired over a target in a state of being packed with several ten to several hundred small sub-munitions (i.e. bomblets) therein, and the bomblets are released or ejected over the target. The cluster munition is called a cluster bomb.

There are various types of bomblets that can be loaded in cluster munitions. A typical form of bomblet is used in dual purpose improved conventional munitions (DPICMs). The DPICMs are manufactured to have a spot ignition structure, such as in a shaped charge, in which each bomblet has a conical penetrator therein.

When the bomblet explodes, the conical penetrator forms a high speed metal form, whereby enough power is generated to penetrate objects several inches thick. After the bomblet explodes, an external bomblet body is fragmented to have a casualty radius of several meters. The aforementioned DPICMs are grenades effective in both purposes of destroying light armored targets and killing personnel but have a relatively high dud rate.

Models, such as M77 and M85 of the DPICM, are extremely widely used in various mother bombs around the world. This means that in order for all models of bomblets to be compatible with one another in terms of the loading and releasing structures and the dropping method thereof, sizes of main parts and appearance features of the bomblets need to be the same or be completely compatible with one another. Therefore, there is a great variety of derivative models of cluster bomblets from past to the present. Even a latest model has a basic ignition structure, a fuse connection structure, and a bomblet body shape very similar to those of other models. In other words, the latest model is limited in a design change.

Meanwhile, there are various methods of dispersing bomblets according to types of mother bombs (artillery-launched, missile-delivered, and air-dropped types). Typically, methods of dispersing include a method of dispersing bomblets in a direction opposite to a flight direction of the bomblets using airflow around the bomblets, a method of dispersing bomblets in a circumferential direction of the bomblets using a spin of the bomblets and inner ejection charges, and a method of forcibly dispersing bomblets in a radius direction of a mother bomb using an explosion of ejection charges in the mother bomb.

As illustrated in FIGS. 1 to 5, an existing cluster bomblet includes a bomblet body 50 and a fuse assembly 60. The bomblet body 50 includes: a cylindrical bomblet body portion 51 packed with high explosives 53 and a support portion 52 having a connecting-tube mounting hole 52*a* formed in a central portion thereof and connected to an upper end of the cylindrical bomblet body portion 51 to seal the upper end of the cylindrical bomblet body portion 51; a conical penetrator 55 being installed inside a rear end portion of the cylindrical bomblet body portion 51; and a connecting tube 56 being mounted in the connecting-tube mounting hole 52*a*. The fuse assembly 60 includes an ignition tube igniting the high explosives 53 through the connecting tube 56; a slider 62 installed at a fuse body to be horizontally movable; a starter screw 61 screw-connected to the fuse body to limit the slider 62 to move and rotated by a ribbon 64 unfolded when ejected from a mother bomb, to allow the slider 62 to move; and a stud 65 inserted into a stud insertion hole 52*b* formed in the support portion 52 and connecting the fuse body to the bomblet body 50, the ignition tube 63 being assembled to the slider 62.

In the bomblet body 50, the cylindrical bomblet body portion 51 and the support portion 52 may be separately formed as illustrated in FIG. 4, but the cylindrical bomblet body portion 51 and the support portion 52 may be integrally formed as illustrated in FIG. 5. The support portion 52 has the connecting-tube mounting hole 52*a* formed in the central portion thereof, and the stud insertion hole 52*b* is formed in each of both sides of the connecting-tube mounting hole 52*a*. The support portion 52 has an assembly surface portion 52' protruding so as to be placed above the upper end of the bomblet body portion 51 and a side surface portion 52" extending slopingly downward from an edge of the assembly surface portion 52' such that a lower portion thereof is assembled to an upper interior of the cylindrical bomblet body portion 51 or is connected to an upper end of the cylindrical bomblet body portion 51.

As illustrated in FIG. 6, the existing cluster bomblets are stacked in a shape in which a bomblet body portion of an upper bomblet is fixed to a support portion 52 of a lower bomblet and a fuse assembly 60 connected to the support portion 52 of the lower bomblet is accommodated in a conical penetrator 55 disposed in the bomblet body portion 51, so as to accommodate more bomblets in a limited space of a mother bomb.

A cluster bomblet is fired over a target in a state of being accommodated in a mother bomb. When the mother bomb arrives over the target, the cluster bomblet is ejected from the mother bomb and is ignited or exploded by an impact caused by the collision thereof with the ground or the target, thereby destroying a light armored vehicle or killing personnel.

While cluster bomblets densely stacked in the mother bomb are rapidly ejected from the mother bomb over the target, a fuse assembly may be impacted by a staked upper bomblet. In addition, while the cluster bomblets are dispersed, the fuse assembly may be impacted by a bomblet body adjacent to a side surface portion thereof. Thus, while the fuse assembly dislodges from the bomblet body or a connection portion is twisted, an inoperation of a fuse can be caused or a misalignment of an explosion system can be generated. As described above, when an impact applied to the fuse assembly acts as a factor in which high explosives of the bomblet are not ignited, the bomblet can not be exploded, thereby generating a non-exploded bomblet.

Of course, most bomblets fall without colliding with one another. However, in a case where the falling bomblets fail to maintain a standing position when colliding with the ground or the fuse assembly, or the fuse assembly of the falling bomblets firstly collides with an inclined ground or a rock, the fuse assembly receives an unintentional great impact. As described above, while the fuse assembly dislodges from the bomblet body or the connection portion is twisted even by the unintentional great impact, an inoperation of a fuse can be caused or an alignment of an explosion system can be twisted. Accordingly, high explosives of the bomblet can not be ignited to generate a non-exploded bomblet.

FIG. 7 illustrates a generation process of a non-exploded bomblet. Part (a) of FIG. 7 illustrates a shape in which bomblets collide with each other when the bomblets are dispersed. Part (b) of FIG. 7 illustrates a shape in which a side surface of a fuse assembly collides with the ground due to an incorrect standing position when the bomblets fall on the ground.

Part (c) of FIG. 7 illustrates a shape in which the fuse assembly dislodges from a bomblet body due to the collision. Part (d) of FIG. 7 illustrates a connection failure of the fuse assembly and a misalignment of an explosion system. Part (e) of FIG. 7 illustrates a damaged shape of the fuse assembly. Parts (a) and (b) illustrate primary causes of generating a non-exploded bomblet. Parts (c) and (d) illustrate specific causes of generating a non-exploded bomblet, caused by the primary causes of Part (a) and (b).

In other words, when cluster bomblets are ejected from a mother bomb, the cluster bomblets are primarily impacted by the mother bomb and an upper bomblet. In addition, while the cluster bomblets are radially dispersed at the same time in a state of being densely accommodated in great numbers, the cluster bomblets are secondarily impacted due to the collision with bomblets adjacent thereto. Finally, the cluster bomblets are thirdly impacted due to the collision with the ground or a rock just before an ignition is operated through an impact function due to the collision with the ground. When the aforementioned impacts are applied to the fuse assembly, components of the fuse assembly may be damaged, the fuse assembly may dislodge from the bomblet body, or an alignment of an ignition tube can be at least in disorder. Finally, high explosives can fail to be ignited, thereby generating a non-exploded bomblet.

The non-exploded bomblet is a factor that may reduce fire power of friendly forces and may cause secondary injuries to civilians. Therefore, various types of self-destruct fuses for removing the non-exploded bomblet have been developed and used.

In this regard, in order to prevent a fuse assembly of a bomblet from dislodging from a bomblet body or a connection portion from being twisted, a technology related to a bomblet having a stud connection structure with increased shearing strength has been developed. In this case, a non-exploded bomblet can be generated as follows.

When bomblets are ejected and dispersed from a mother bomb, a fuse assembly may collide with surrounding bomblets, and components of the fuse assembly may be damaged, so that the fuse assembly may be disabled. In a case where the bomblets free-fall and fail to maintain a standing position when colliding with the ground, or the fuse assembly of the falling bomblets firstly collides broadside with an inclined ground or a rock, the components of the fuse assembly may be damaged, so that the fuse assembly can be disabled.

Therefore, in order to prevent a damage of a fuse assembly and ensure ignition of a bomblet, there is a need for a bomblet having a structure able to secure connection strength between a fuse assembly and a bomblet body and protect a fuse slider at least having a self-destruct function and including an assembled ignition tube.

Meanwhile, as a search result of a prior art for preventing the generation of a non-exploded bomblet, various technologies, such as a technology for igniting high explosives through an auxiliary ignition tube, have been searched for. Some of the various technologies will be introduced as follows.

Korean Patent No. 0306357B1 discloses a self-destruct device for a grenade, in which the grenade free-falling on the ground can be automatically exploded after a certain time has elapsed, workability can be improved by forming an accommodation groove connecting a delay tube assembly packed with ignition powders, delay powders, and connection powders to a slider of the grenade, and the delay tube assembly can block the water penetration through a side surface or an inlet of the slider, thereby preventing a failure incident.

Korean Patent No. 1078153B1 discloses a self-destruct device for a grenade, in which an auxiliary ignition tube can be ignited irrespective of rotational inertia force of the grenade, more grenades can be loaded in a transfer body (shell, rocket, missile, or the like) by reducing a size of a fuse, and the grenade can be ejected at a higher altitude by lengthily forming a delay tube assembly in a U-shape to further increase a self-destruct setting time.

Korean Patent No. 1503786B1 discloses a cluster bomblet having a stud connection structure with increased shearing strength, in which since a head of a stud having a wide cross sectional area receives side shearing load by placing a stepped surface of the stud below a fuse attaching surface, and a leg of the stud does not endure unnecessary shearing load by inserting the leg into a case connection hole in a medium fit manner or a loose fit manner when the leg is inserted into the case connection hole, and then, when the head is inserted into a fuse connection hole, an existing stud connection method can be maintained, a shape specification of a main portion of the cluster bomblet can be compatible with those of an existing bomblet, and shearing load applied to a key connection member (i.e. the stud) can be substantially increased, thereby preventing damage and separation between a fuse and a case fragment even when the cluster bomblet laterally receives a strong impact during the ejection thereof from a cluster bomb and the landing thereof on the ground.

DISCLOSURE

Technical Problem

Accordingly, the present invention has been made keeping in mind the above problems occurring in the prior art, and an object of the present invention is to provide a cluster bomblet having a bomblet body for protecting a fuse, in which a main portion of a fuse assembly is protected by the bomblet body to prevent an alignment of an ignition tube from being twisted or the fuse assembly from being separated or dislodging from the bomblet body even when an impact is applied to the fuse assembly, so that a non-exploded bomblet is not generated.

Another object of the present invention is to provide a cluster bomblet having a bomblet body for protecting a fuse, the cluster bomblet being able to secure connection strength between a fuse assembly and a bomblet body such that high explosives within the bomblet can be reliably ignited and to protect a fuse slider having a self-destruct function and including an assembled ignition tube.

Technical Solution

In order to accomplish the above object, the present invention provides a cluster bomblet having a bomblet body for protecting a fuse. The cluster bomblet may include: a cylindrical bomblet body portion packed with high explosives; a fuse assembly including a striker screw for igniting the high explosives and being connected to a top side of the cylindrical bomblet body portion; and a conical penetrator provided inside a rear end portion of the cylindrical bomblet body portion.

The cluster bomblet may further include an upper cover sealing the top side of the cylindrical bomblet body portion. A connecting tube connecting a fuse tube of the fuse assembly and the connecting tube may be disposed in the upper cover, and a stud assembled to the fuse assembly may be inserted into the upper cover.

The upper cover may include: an assembly surface portion on which the fuse assembly is seated, the assembly surface portion having a connecting-tube mounting hole in which the connecting tube is disposed and a stud insertion hole into which the stud is inserted; and a side wall portion extending upward from an edge of the assembly surface portion to prevent separation of the mounted fuse assembly.

The side wall portion may extend to a lower side of the assembly surface portion.

The upper cover may have an opening formed in one side thereof, wherein a slider of the fuse assembly is inserted into the opening. An opening corresponding to the opening of the upper cover may be formed in one side of the bomblet body portion.

The side wall portion of the upper cover may at least extend to a height higher than a height of the slider of the fuse assembly. When the upper cover is connected to the cylindrical bomblet body, a height, at which the upper cover is connected to the cylindrical bomblet body, may be variably adjusted on an upper portion of the cylindrical bomblet body. The upper cover and the cylindrical bomblet body may be integrally formed.

Advantageous Effects

As described above, according to the cluster bomblet of the present invention, a lower portion of a fuse body, in which a main portion of a fuse assembly is disposed, is placed on an assembly surface portion of an upper cover and a side wall portion extends upward from an edge of the assembly surface portion. The fuse assembly can be protected by the side wall portion of the upper cover to be protected from an external impact. This can consequently prevent the fuse assembly from being separated and an explosion system from being misaligned, thereby minimizing a non-exploded bomblet.

Since the side wall portion of the upper cover extends to a lower side of the assembly surface portion and is connected to a bomblet body, a contact area between the upper cover and the bomblet body can be increased to improve connection strength.

Since openings are formed in the side wall portion of the upper cover and the bomblet body, respectively, allowing a slider to be inserted thereinto, the slider can be firmly supported, and the misalignment of the explosion system can be prevented.

In addition, since the side wall portion of the upper cover extends to a height higher than that of the slider of the fuse assembly and extends to a position of an end of a penetrator of an upper cluster bomblet, the fuse assembly can be more reliably protected, and when the cluster bomblets are stacked, the cluster bomblets can be connected to other cluster bombs, thereby improving the reliability of stacking portions.

DESCRIPTION OF THE REFERENCE NUMERALS IN THE DRAWINGS

Figure 1:
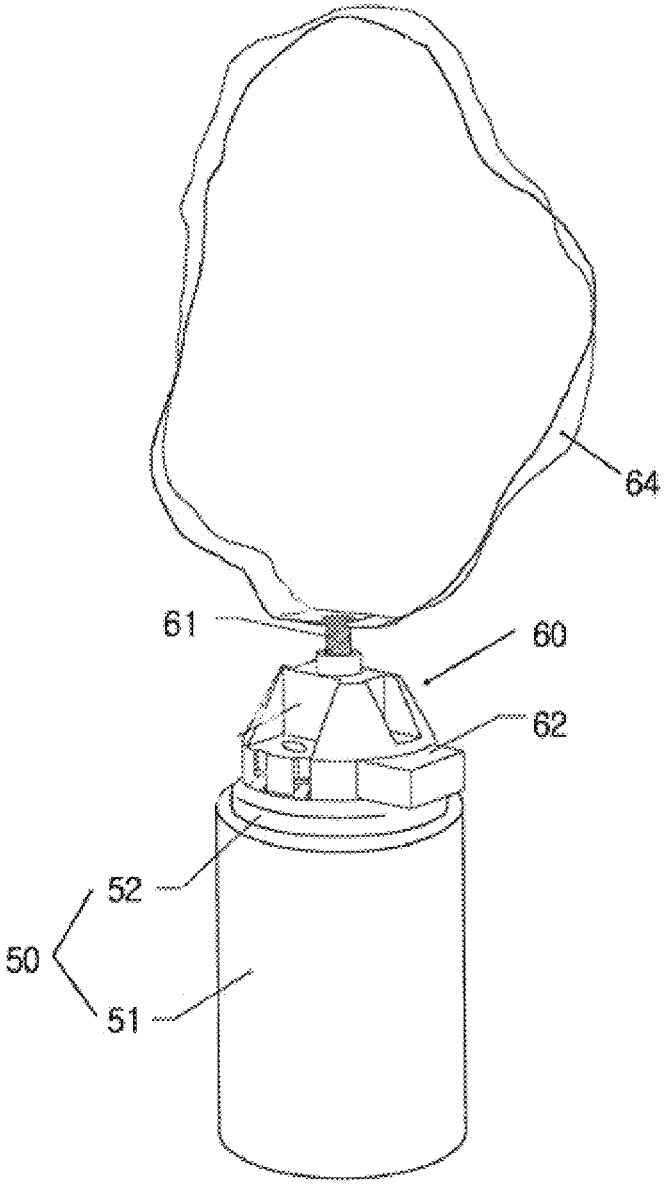
FIG. 1 is a perspective view illustrating an existing cluster bomblet.
Figure 2:
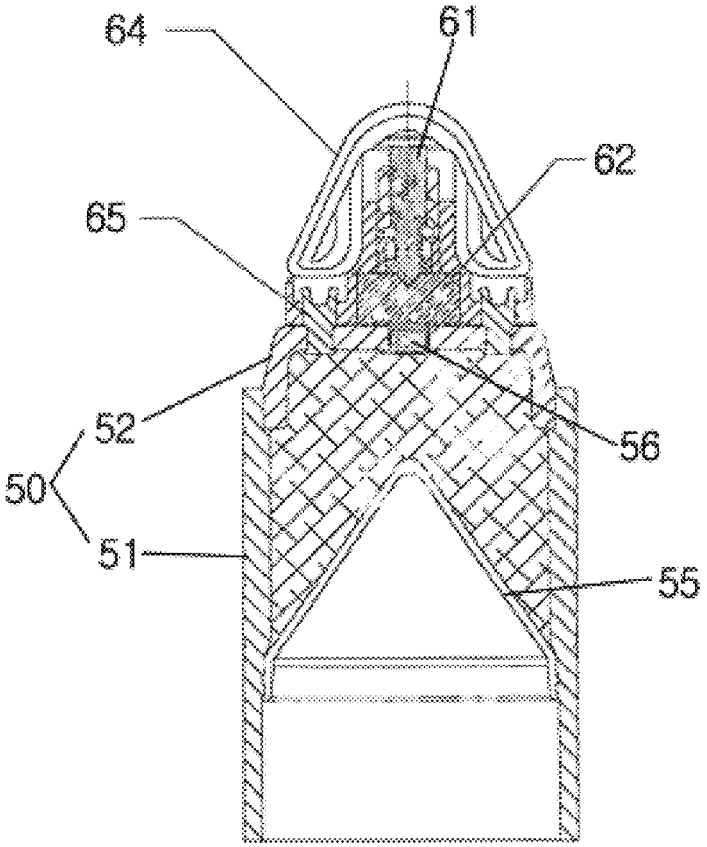
FIG. 2 is a cross-sectional view illustrating the existing cluster bomblet.
Figure 3:
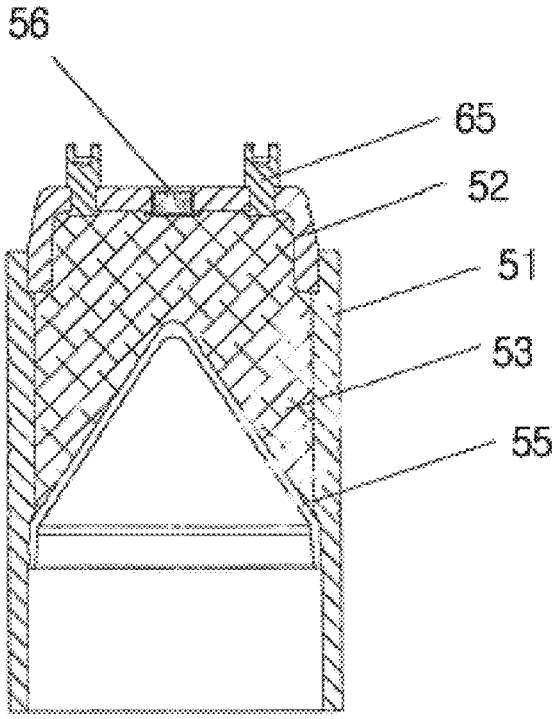
FIG. 3 is a cross-sectional view illustrating an interior of a bomblet body of the existing cluster bomblet.
Figure 4:
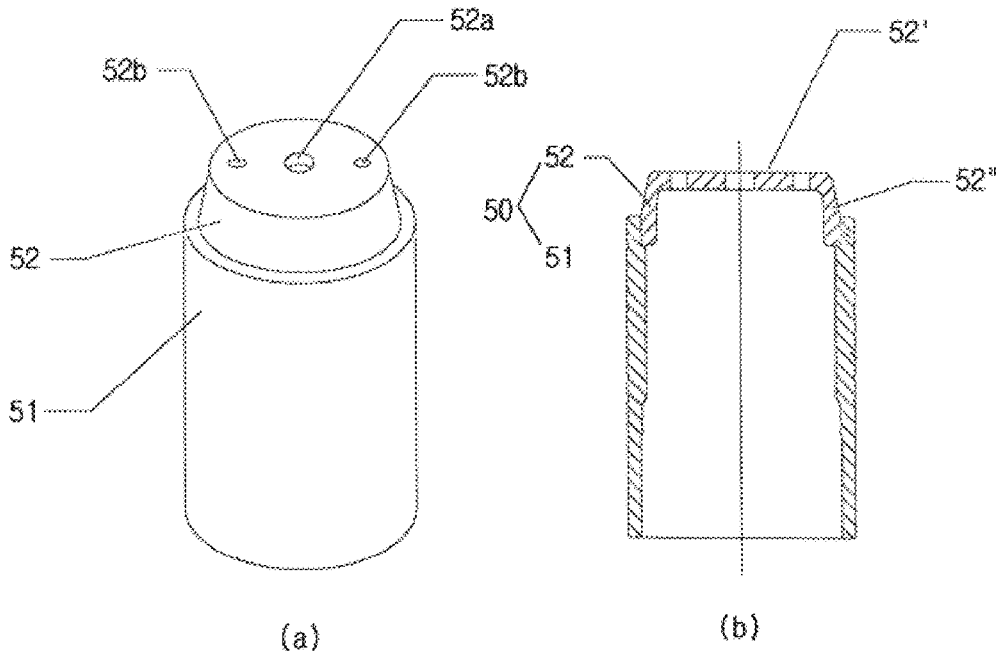
FIG. 4 shows a perspective view and a cross-sectional view illustrating the bomblet body of the existing cluster bomblet.
Figure 5:
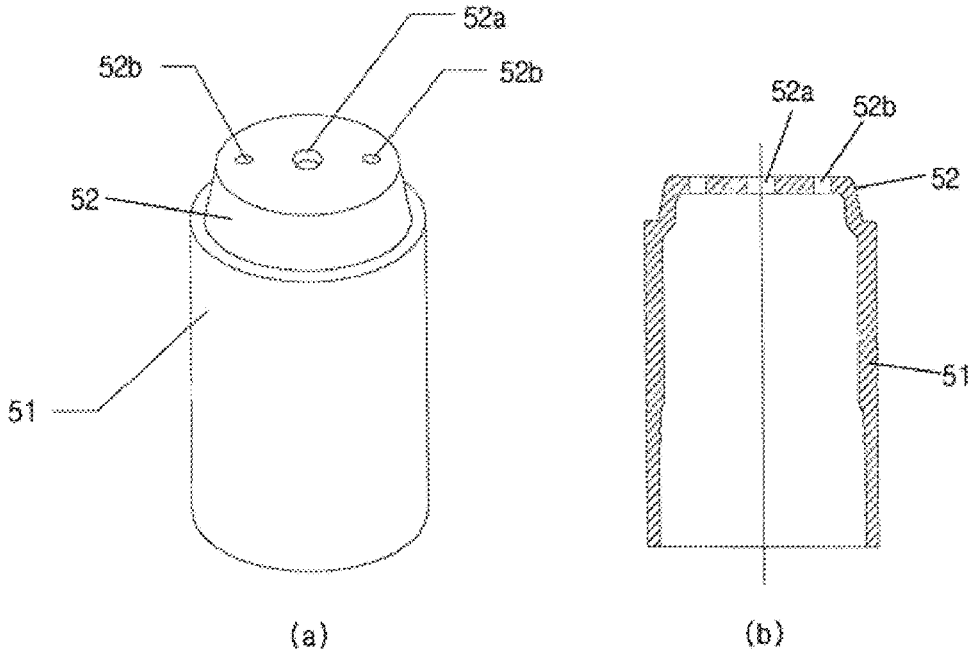
FIG. 5 shows a perspective view and a cross-sectional view illustrating another example of an existing bomblet body.
Figure 6:
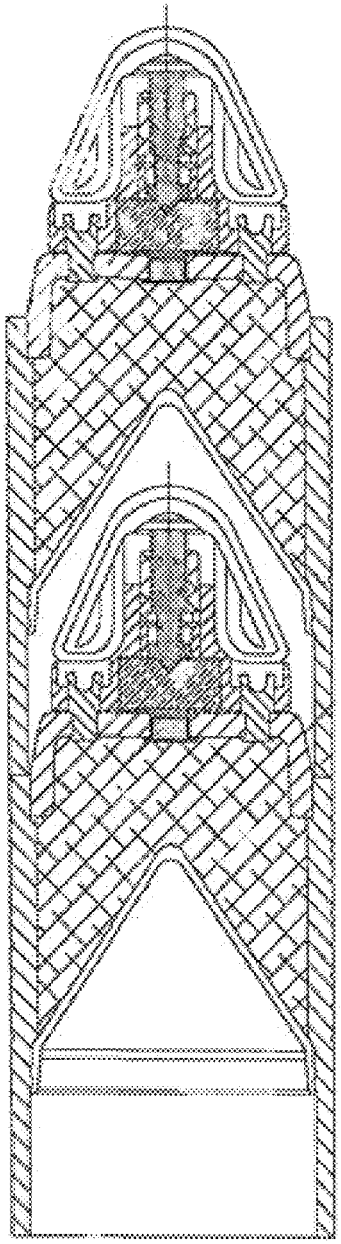
FIG. 6 is a reference view illustrating a shape in which the existing cluster bomblets are stacked.
Figure 7:
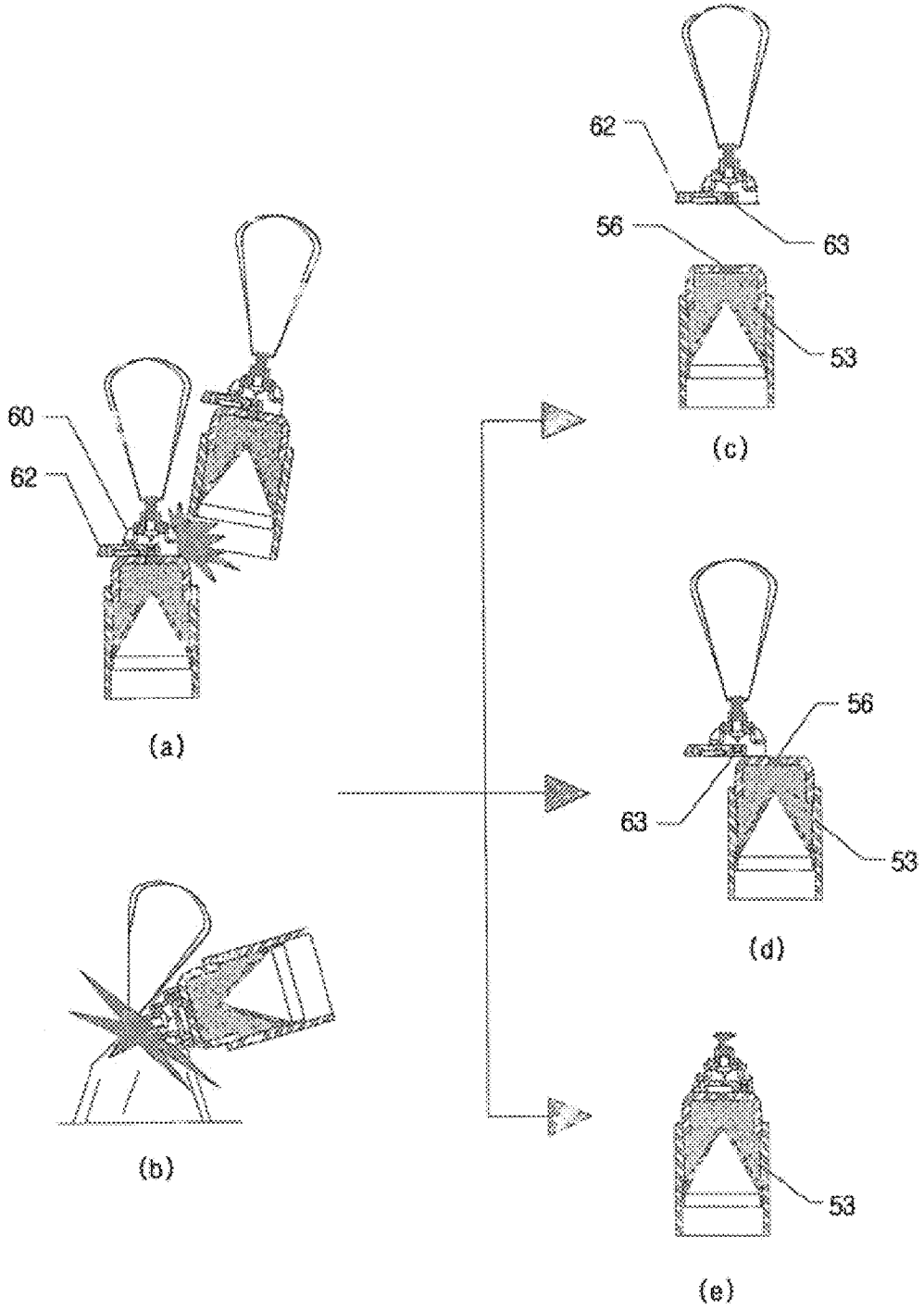
FIG. 7 shows reference views illustrating dud examples of the existing cluster bomblet.
Figure 8:
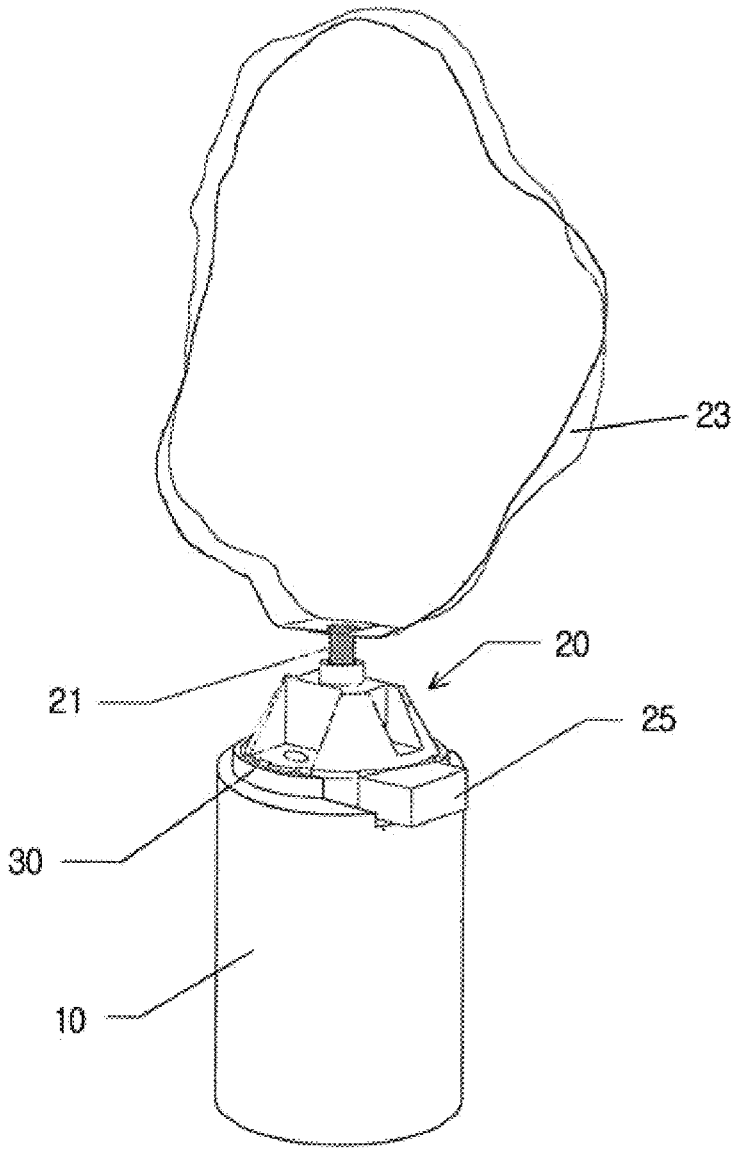
FIG. 8 is a perspective view illustrating a cluster bomblet having a bomblet body for protecting a fuse, according to the present invention.
Figure 9:
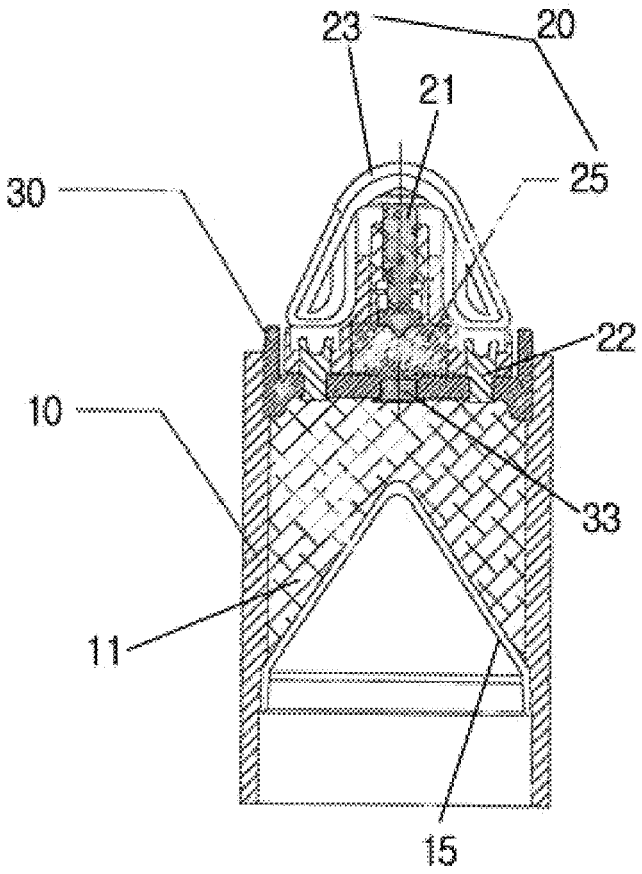
FIG. 9 is a cross-sectional view illustrating the cluster bomblet according to the present invention
Figure 10:
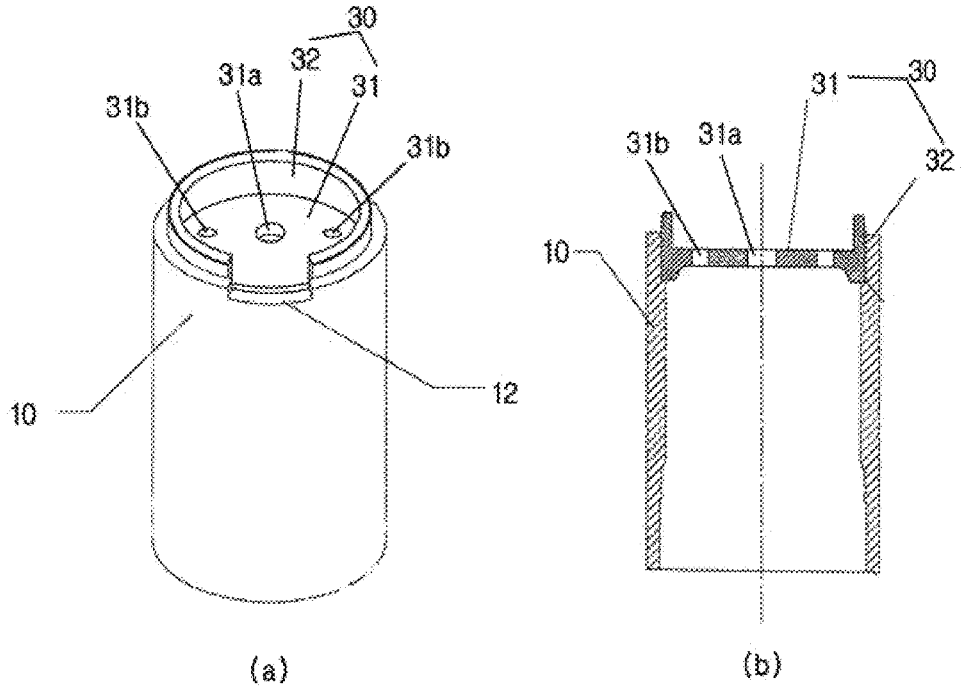
FIG. 10 shows a perspective view and a cross-sectional view illustrating the cylindrical bomblet body according to the present invention.
Figure 11:
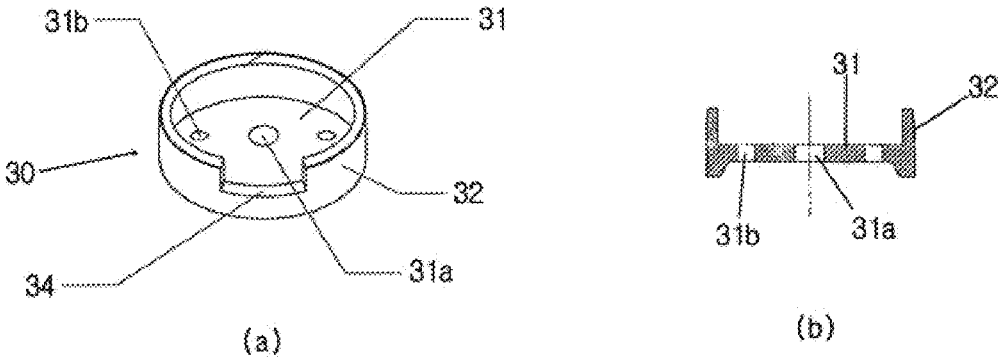
FIG. 11 shows a perspective view and a cross-sectional view illustrating an upper cover that is an essential portion according to the present invention.
Figure 12:
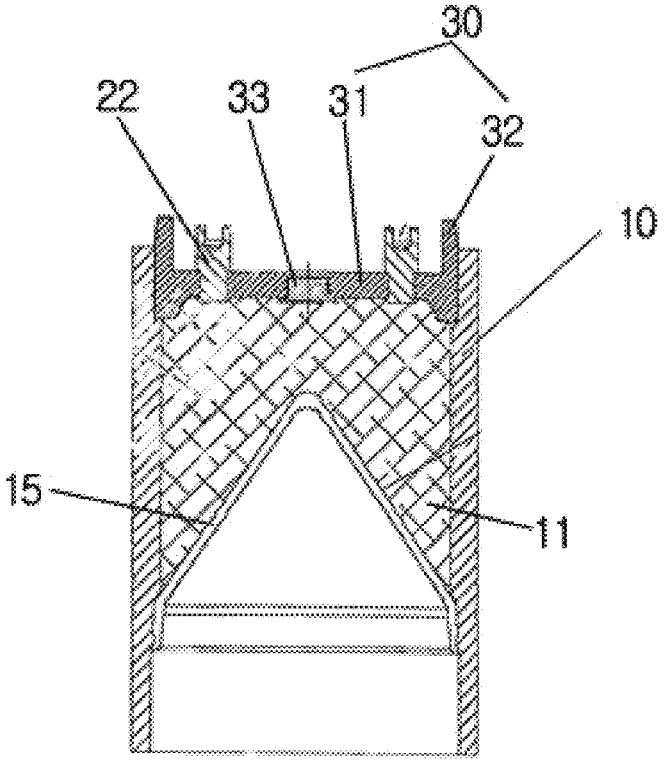
FIG. 12 is a cross-sectional view illustrating an interior of the cylindrical bomblet body according to the present invention.

10: cylindrical bomblet body; 11: high explosives
12: opening; 15: conical penetrator
20: fuse assembly; 21: striker screw
22: stud; 23: ribbon
25: slider;
30: upper cover; 31: assembly surface portion
31*a*: connecting-tube mounting hole; 31*b*: stud insertion hole
32: side wall portion; 33: connecting tube; 34: opening

Mode for Invention

Hereinafter, a cluster bomblet having a bomblet body for protecting a fuse according to the present invention will be described with reference to the accompanying drawings.

As illustrated in FIGS. 8 to 16, the cluster bomblet according to the present invention includes: a cylindrical bomblet body portion 10 packed with high explosives 11; a fuse assembly 20 including a striker screw 21 for igniting the high explosives 11 and being connected to a top side of the cylindrical bomblet body portion 10; a conical penetrator 15 provided inside a rear end portion of the cylindrical bomblet body portion 10; and an upper cover 30 sealing the top side of the cylindrical bomblet body portion 10, a connecting tube 33 connecting a fuse tube of the fuse assembly 20 and the connecting tube 33 being installed in the upper cover 30, and a stud 22 assembled to the fuse assembly 20 being inserted into the upper cover 30.

Here, the upper cover 30 may have an assembly surface portion 31 on which the fuse assembly 20 is seated and a side wall portion 32 extending upward from an edge of the assembly surface portion 31 to prevent the separation of the mounted fuse assembly 20. The assembly surface portion 31 has a connecting-tube mounting hole 31*a* in which the connecting tube 33 is disposed and a stud insertion hole 31*b* into which the stud 22 is inserted. The side wall portion 32 may extend to a lower side of the assembly surface portion 31.

The upper cover 30 may have an opening 34 formed in one side thereof, a slider 25 of the fuse assembly 20 being inserted into the opening 34. The cylindrical bomblet body portion 10 may have an opening 12 formed in an upper one side thereof and corresponding to the opening 34 of the upper cover 30. However, the opening 12 of the cylindrical bomblet body portion 10 may not be formed according to an insertion position of the upper cover 30.

Figure 14:
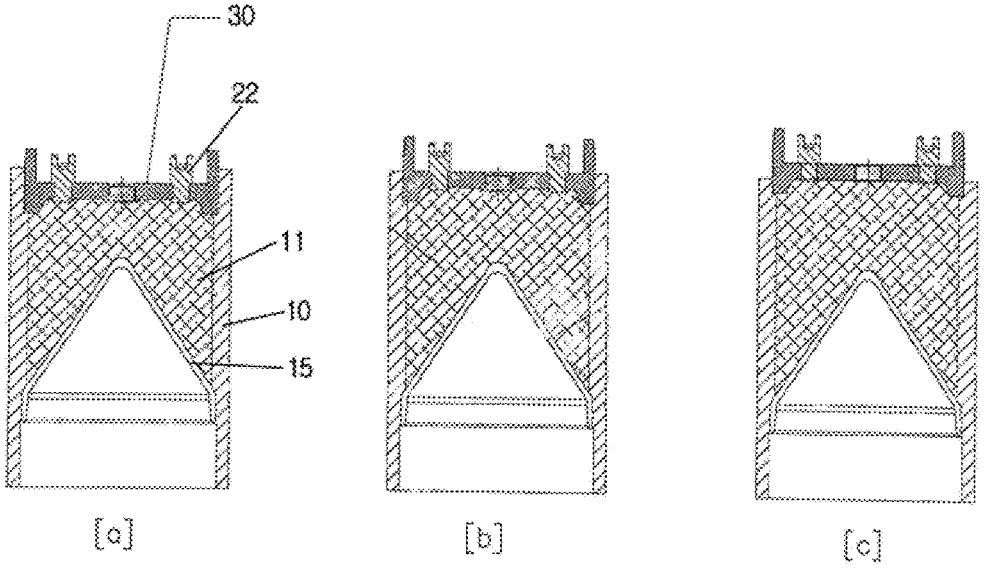
FIG. 14 is a reference view illustrating a connection position of the upper cover that is the essential portion according to the present invention.

A height, at which the upper cover 30 is connected to the cylindrical bomblet body portion 10, may be variable and may be appropriately adjusted as in FIG. 14.

That is, as illustrated in (a), the upper cover 30 may be deeply connected to the cylindrical bomblet body portion 10 such that the assembly surface portion 31 of the upper cover 30 is disposed at a height lower than that of an upper end of the cylindrical bomblet body portion 10. As illustrated in (b), the upper cover 30 may be connected to the cylindrical bomblet body portion 10 such that the assembly surface portion 31 of the upper cover 30 is disposed at a height equal to that of the upper end of the cylindrical bomblet body portion 10. As illustrated in (c), the upper cover 30 may be connected to the cylindrical bomblet body portion 10 such that the assembly surface portion 31 of the upper cover 30 is disposed at a height higher than that of the upper end of the cylindrical bomblet body portion 10. In this case, the respective connection conditions are selected depending on exterior exposure environments of a bomblet and a fuse according to characteristics of a mother bomb or depending on requirements, such as an amount of filled powder according to requirement performance of the bomblet. In addition, in the cases of (b) and (c), since the assembly surface portion 31 of the upper cover 30 is disposed at a height equal to or higher that of the upper end of the cylindrical bomblet body portion 10, the opening 12 of the cylindrical bomblet body portion 10 does not need to be formed.

Figure 15:
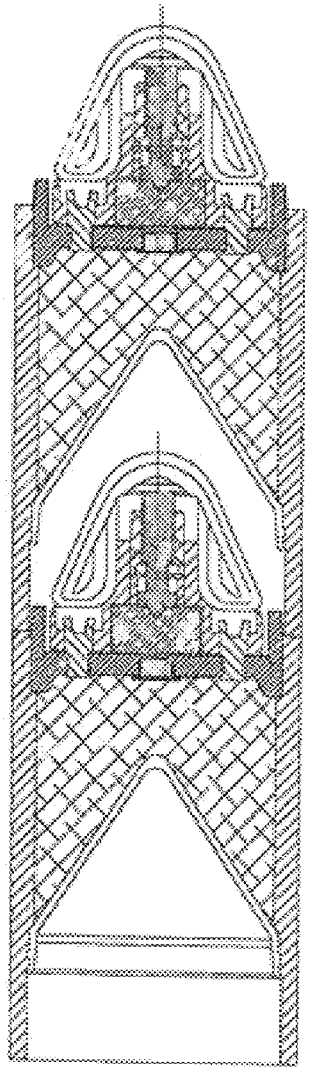
FIG. 15 is a reference view illustrating a shape in which the cluster bomblets according to the present invention are stacked.

As illustrated in FIG. 15, in a process of stacking and loading the cluster bomblets into a cluster bomb (mother bomb), since the fuse assembly 20 of an adjacent cluster bomblet is inserted into the conical penetrator 15 of an upper cluster bomblet and a portion of the side wall portion 32 of the upper cover 30 of the adjacent cluster bomblet is inserted through a lower end of the cylindrical bomblet body portion 10 of the upper cluster bomblet, the cluster bomblets according to the present invention are firmly stacked.

Figure 16:
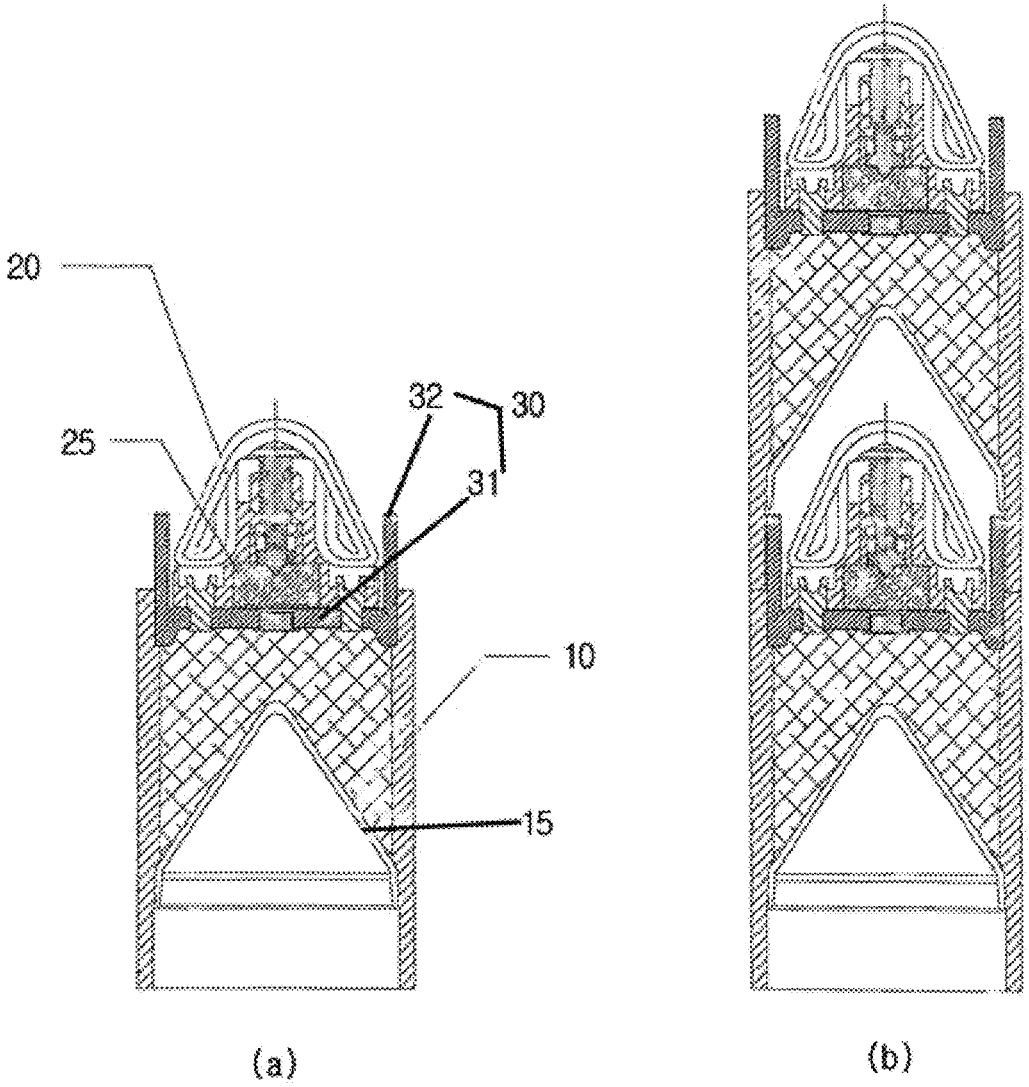
FIG. 16 shows an inner cross-sectional view and a stacking state view illustrating a modification example of the present invention.

As illustrated in FIG. 16, the side wall portion 32 of the upper cover 30 may at least extend to a height higher than that of the slider 25 of the fuse assembly 20 of the upper cluster bomblet and may extend to a position of an end of the penetrator of the upper cluster bomblet. Due to the aforementioned structure, the fuse assembly 20 is firmly disposed inside of the upper cover 30. In addition, when the cluster bomblets are stacked, the reliability of a staking state is further improved by deeply inserting the side wall portion 32 of the upper cover 30 through the lower end of the cylindrical bomblet body portion 10 of the upper cluster bomblet.

Figure 13:
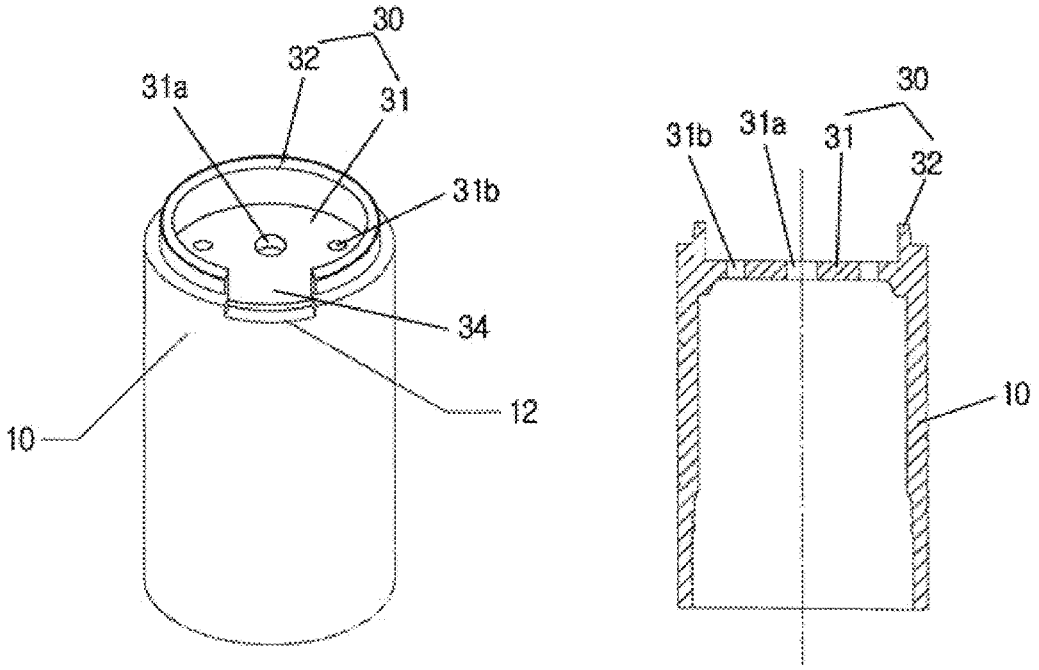
FIG. 13 shows a perspective view and a cross-sectional view illustrating another example of the cylindrical bomblet body according to the present invention.

Meanwhile, the upper cover 30 may be formed separately from the cylindrical bomblet body portion 10, and the upper cover 30 and the cylindrical bomblet body portion 10 may be integrally formed as illustrated in FIG. 13. In this case, the openings 34 and 12 are formed in the upper cover 30 and the cylindrical bomblet body portion 10, respectively.

The technical idea of the present invention has been described with reference to specific embodiments. In addition, there may be simple variations or simple expansion examples not included in embodiments described in the present specification, but the technical idea of the present invention should be construed on the basis of the appended claims rather than a technical interpretation category of embodiments.

What is claimed is:

1. A cluster bomblet having a bomblet body for protecting a fuse, the cluster bomblet comprising:

the cylindrical bomblet body portion (10) packed with high explosives (11);

a fuse assembly (20) comprising a striker screw (21) for igniting the high explosives (11) and being connected to a top side of the cylindrical bomblet body portion (10);

a conical penetrator (15) provided inside a rear end portion of the cylindrical bomblet body portion (10); and an upper cover (30) sealing the top side of the cylindrical bomblet body portion (10), wherein a connecting tube (33) connecting a fuse tube of the fuse assembly (20) is disposed in the upper cover (30) , and a stud (22) assembled to the fuse assembly (20) is inserted into the upper cover (30), wherein the upper cover (30) comprises:

an assembly surface portion (31) on which the fuse assembly (20) is seated, the assembly surface portion (31) having a connecting-tube mounting hole (31*a*) in which the connecting tube (33) is disposed and a stud insertion hole (31*b*) into which the stud (22) is inserted; and a side wall portion (32) extending upward from an edge of the assembly surface portion (31) to prevent separation of the mounted fuse assembly (20) .

2. The cluster bomblet of claim 1, wherein the side wall portion (32) extends to a lower side of the assembly surface portion (31).

3. The cluster bomblet of claim 1, wherein the upper cover (30) has an opening (34) formed in one side thereof, a slider (25) of the fuse assembly (20) being inserted into the opening (34).

4. The cluster bomblet of claim 1, wherein the side wall portion (32) of the upper cover (30) at least extends to a height higher than a height of the slider (25) of the fuse assembly (20).

5. The cluster bomblet of claim 1, wherein, when the upper cover (30) is connected to the cylindrical bomblet body portion (10), a height, at which the upper cover (30) is connected to the cylindrical bomblet body portion (10), is variably adjusted on an upper portion of the cylindrical bomblet body portion (10).

6. The cluster bomblet of claim 1, wherein the upper cover (30) and the cylindrical bomblet body portion (10) are integrally formed.

7. The cluster bomblet of claim 2, wherein the upper cover (30) and the cylindrical bomblet body portion (10) are integrally formed.

8. The cluster bomblet of claim 3, wherein the upper cover (30) and the cylindrical bomblet body portion (10) are integrally formed.

9. The cluster bomblet of claim 4, wherein the upper cover (30) and the cylindrical bomblet body portion (10) are integrally formed.

10. The cluster bomblet of claim 5, wherein the upper cover (30) and the cylindrical bomblet body portion (10) are integrally formed.

* * * * *